US007104386B2

(12) United States Patent
Ogura et al.

(10) Patent No.: US 7,104,386 B2
(45) Date of Patent: Sep. 12, 2006

(54) SLOPED PART HIGH-SPEED ESCALATOR

(75) Inventors: Manabu Ogura, Tokyo (JP); Takashi Yumura, Tokyo (JP); Yasumasa Haruta, Tokyo (JP); Tatsuya Yoshikawa, Tokyo (JP); Shinji Nagaya, Tokyo (JP); Joichi Nakamura, Fukuoka (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 442 days.

(21) Appl. No.: 10/483,048

(22) PCT Filed: Dec. 4, 2002

(86) PCT No.: PCT/JP02/12716
§ 371 (c)(1),
(2), (4) Date: Jan. 7, 2004

(87) PCT Pub. No.: WO03/062119
PCT Pub. Date: Jul. 31, 2003

(65) Prior Publication Data

US 2004/0195046 A1 Oct. 7, 2004

(30) Foreign Application Priority Data

Jan. 21, 2002 (JP) ..... 2002-012147

(51) Int. Cl.
*B65B 21/12* (2006.01)

(52) U.S. Cl. ..... 198/334

(58) Field of Classification Search ..... 187/277, 187/293; 198/321, 332, 326, 333, 334
See application file for complete search history.

(56) References Cited

U.S. PATENT DOCUMENTS

| | | | | |
|---|---|---|---|---|
| 3,672,484 | A * | 6/1972 | Angioletti et al. | 198/334 |
| 3,908,811 | A * | 9/1975 | Cortese et al. | 198/334 |
| 4,240,537 | A * | 12/1980 | Dunstan | 198/334 |
| 5,115,899 | A * | 5/1992 | Nakatani | 198/334 |
| 6,588,573 | B1 * | 7/2003 | Ogura et al. | 198/334 |
| 6,591,959 | B1 * | 7/2003 | Ogura et al. | 198/334 |
| 6,796,416 | B1 * | 9/2004 | Ogura et al. | 198/334 |
| 6,832,678 | B1 * | 12/2004 | Ogura et al. | 198/322 |
| 2003/0136634 | A1 * | 7/2003 | Ogura et al. | 198/334 |

FOREIGN PATENT DOCUMENTS

| | | |
|---|---|---|
| EP | 0 243 572 | 1/1987 |
| JP | 51-116586 | 10/1976 |
| JP | 2001-348179 | 12/2001 |
| JP | 2002-326780 | 11/2002 |

* cited by examiner

*Primary Examiner*—Jonathan Salata
(74) *Attorney, Agent, or Firm*—Leydig, Voit & Mayer, Ltd.

(57) ABSTRACT

In an escalator having a high-speed inclined portion, shape of an auxiliary track in a speed-changing region for steps is determined by finding a positional relationship between step link roller shafts of at least one of the steps and an adjacent step from a step speed profile representing speed of the step link roller shafts as a function of time. The shape of a riser is determined such that the riser aligns with a relative movement locus of the adjacent step by finding a relative positional relationship between the step and the adjacent step from the step speed profile.

4 Claims, 8 Drawing Sheets

SLOPED PART HIGH-SPEED ESCALATOR

TECHNICAL FIELD

The present invention relates to a high-speed inclined portion escalator in which traveling speed of steps in an intermediate inclined portion is higher than the traveling speed of the steps in an upper landing portion and a lower landing portion.

BACKGROUND ART

In recent years, a large number of escalators having high lift ranges have been installed in subway stations, etc. In escalators of this kind, passengers must stand still on the steps for a long time, and many passengers feel uncomfortable. Because of this, escalators that operate at high speeds have been developed, but there is an upper limit to the operating speeds thereof for passengers to get on and off safely.

In answer to this, high-speed inclined portion escalators have been proposed in which it is possible for the amount of time spent riding the escalator to be shortened by operating at low speed at upper and lower landing portions where the passengers get on and off, operating to accelerate and decelerate in an upper curved portion and a lower curved portion, and operating at high speed in the intermediate inclined portion. A high-speed inclined portion escalator of this kind is disclosed in Japanese Patent Laid-Open No. SHO 51-116586 (Gazette), for example.

However, since the conventional high-speed inclined portion escalator merely performs acceleration and deceleration from low-speed operation to high-speed operation, or from high-speed operation to low-speed operation, a large acceleration such as that shown in FIG. 10 (deceleration in the figure), for example, arises in the steps in the speed-changing regions, and there is a risk that passengers riding the steps will be subjected to discomfort.

DISCLOSURE OF THE INVENTION

The present invention aims to solve the above problems and an object of the present invention is to provide a high-speed inclined portion escalator enabling smooth speed changing to be performed without imparting a large acceleration.

In order to achieve the above object, according to one aspect of the present invention, there is provided a high-speed inclined portion escalator including: a main frame; a drive rail disposed on the main frame, the main track forming a cyclic path; a plurality of steps having a tread, a riser disposed on an edge portion of the tread, a step link roller shaft, and a step link roller rolling around the step link roller shaft, the step link roller being guided by the main track, the plurality of steps being linked endlessly and being moved cyclically along the cyclic path, a plurality of linking mechanisms for linking the step link roller shafts of mutually-adjacent pairs of the steps and changing a pitch between the step link roller shafts by changing shape, a rotatable auxiliary roller disposed on each of the linking mechanisms; and an auxiliary track disposed on the main frame, the auxiliary track changing a traveling speed of the steps depending on position by guiding movement of the auxiliary rollers to change the shape of the linking mechanisms, wherein: a shape for the auxiliary track in a speed-changing region for the steps is determined by finding a positional relationship between the step link roller shafts of at least one of the steps and an adjacent step from a step speed profile representing a speed of the step link roller shafts relative to time, and a shape for the riser is determined such that the riser aligns with a relative movement locus of the adjacent step by finding a relative positional relationship between the step and the adjacent step from the step speed profile.

BEST MODE FOR CARRYING OUT THE INVENTION

Preferred embodiments of the present invention will now be explained with reference to the drawings.

Embodiment 1

Figure 1:
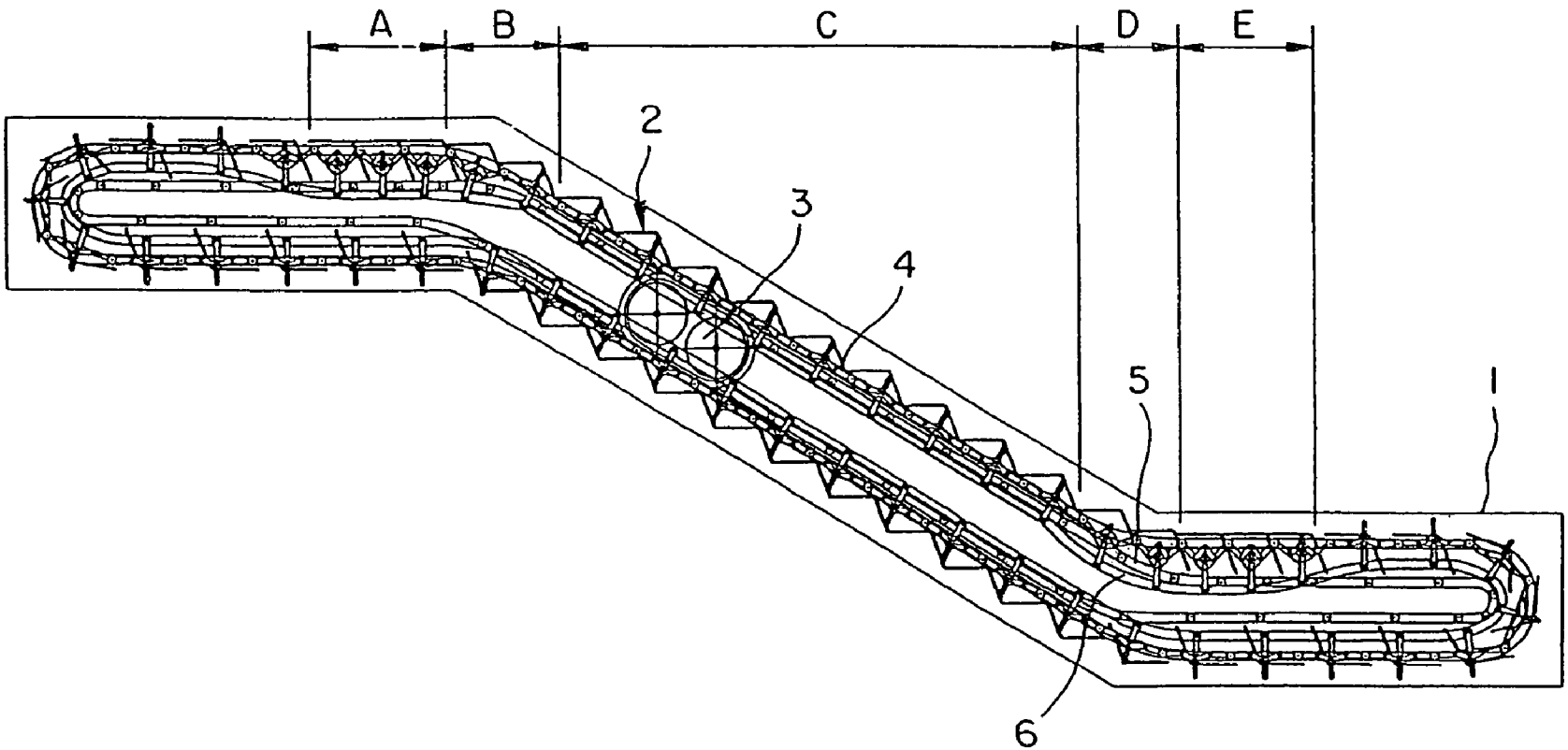
FIG. 1 is a schematic side elevation showing a high-speed inclined portion escalator according to an example of a preferred embodiment of the present invention.

FIG. 1 is a schematic side elevation showing a high-speed inclined portion escalator according to an example of a preferred embodiment of the present invention. In the figure, a plurality of steps 2 linked endlessly are disposed in a main frame 1. The steps 2 are driven by a drive unit (a step driving means) 3, and are moved cyclically.

A pair of main tracks 4 forming a cyclic path for the steps 2, a pair of trailing tracks 5 for controlling the attitude of the steps 2, and a pair of auxiliary tracks 6 for changing a pitch between adjacent steps 2 are disposed on the main frame 1.

The cyclic path for the steps 2 has: a forward section, a return section, an upper inversion portion, and a lower inversion portion. The forward section of the cyclic path has: an upper landing portion (an upper horizontal portion) A, an upper curved portion B, an intermediate inclined portion (a constant inclination portion) C, a lower curved portion D, and a lower landing portion (a lower horizontal portion) E.

Figure 2:
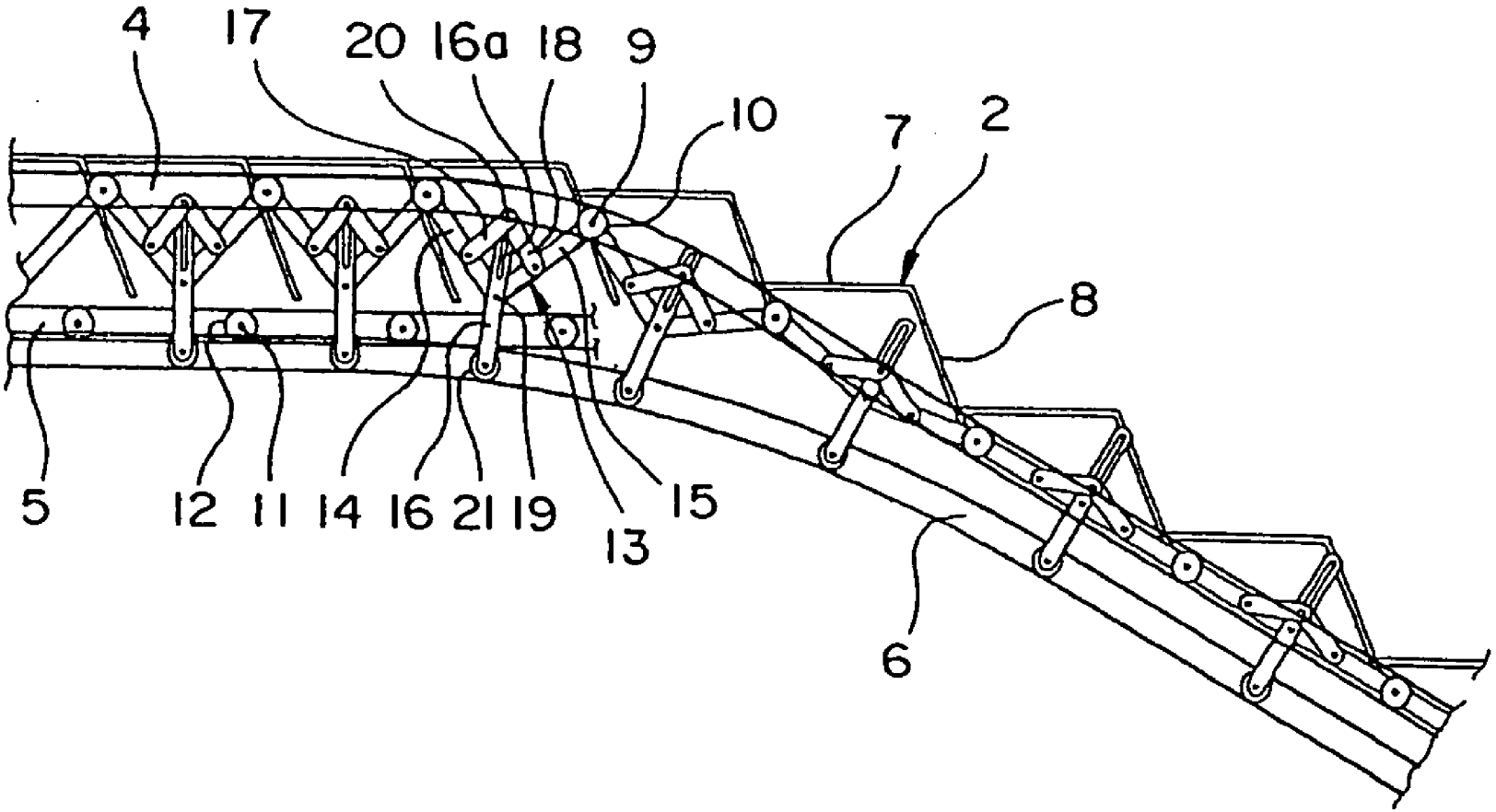
FIG. 2 is a side elevation showing the upper curved portion of FIG. 1 enlarged.

Next, FIG. 2 is a side elevation showing a vicinity of the upper curved portion B in FIG. 1 enlarged. The steps 2 have: treads 7 for carrying passengers; curved risers 8 formed on one edge in a depth direction of the treads 7; step link roller shafts 9; pairs of step link rollers 10 that are rotatable around the step link roller shafts 9; trailing roller shafts 11; and pairs of trailing rollers 12 that are rotatable around the trailing roller shafts 11. The step link rollers 10 roll along the main tracks 4. The trailing rollers 12 roll along the trailing tracks 5.

The step link roller shafts 9 of adjacent steps 2 are linked to each other by linking mechanisms (folding links) 13. Each of the linking mechanisms 13 has first to fifth links 14 to 18.

First end portions of the first links 14 are linked pivotably to the step link roller shafts 9. Second end portions of the first links 14 are linked pivotably to intermediate portions of the third links 16 by means of shafts 19. First end portions of the second links 15 are linked pivotably to the step link roller shafts 9 of the adjacent steps 2. Second end portions of the second links 15 are linked pivotably by means of the shafts 19 to the intermediate portions of the third links 16.

First end portions of the fourth links 17 are connected pivotably to intermediate portions of the first links 14. First end portions of the fifth links 18 are connected pivotably to intermediate portions of the second links 15. Second end portions of the fourth and fifth links 17 and 18 are linked to first end portions of the third links 16 by means of sliding shafts 20.

Guiding grooves 16*a* for guiding sliding of the sliding shafts 20 in the longitudinal direction of the third links 16 are disposed on the first end portions of the third links 16. Rotatable auxiliary rollers 21 are disposed on second end portions of the third links 16. The auxiliary rollers 21 are guided by the auxiliary tracks 6.

A pitch between the step link roller shafts 9, and thus a relative pitch between adjacent steps 2, is changed by the auxiliary rollers 21 being guided by the auxiliary tracks 6 to change the shape of the linking mechanisms 13 so as to fold and unfold. Conversely, tracks of the auxiliary tracks 6 are designed such that the relative pitch between adjacent steps 2 changes.

Next, operation will be explained. The speed of the steps 2 is changed by changing the pitch between the step link roller shafts 9 of adjacent steps 2. In other words, the pitch between the step link roller shafts 9 is minimized in the upper landing portion A and the lower landing portion E where the passengers get on and off, and the steps 2 move at low speed. The pitch between the step link roller shafts 9 is maximized in the intermediate inclined portion C, and the steps 2 move at high speed. In addition, the pitch between the step link roller shafts 9 changes in the upper curved portion B and the lower curved portion D, which constitute speed-changing regions, and the steps 2 accelerate or decelerate.

The first, second, fourth, and fifth links 14, 15, 17, and 18 constitute a four-link "pantograph" linking mechanism, enabling the angle formed by the first and second links 14 and 15 to be enlarged and reduced with the third link 16 as an axis of symmetry. Thus, the pitch between the step link roller shafts 9 linked by the first and second links 14 and 15 can be changed.

In the landing portions A and E in FIG. 1, the pitch between the step link roller shafts 9 of adjacent steps 2 is minimized. From this state, when the distance between the main tracks 4 and the auxiliary tracks 6 is reduced, the linking mechanisms 13 operate in a similar manner to the operation of the frame of an umbrella as the umbrella is being opened out, increasing the pitch between the step link roller shafts 9 of the adjacent steps 2.

The distance between the main tracks 4 and the auxiliary tracks 6 is smallest in the intermediate inclined portion C in FIG. 1, and the pitch between the step link roller shafts 9 of the adjacent steps 2 is maximized. Consequently, the speed of the steps 2 is maximized in this region. In this state, the first and second links 14 and 15 are disposed almost in a straight line.

Figure 3:
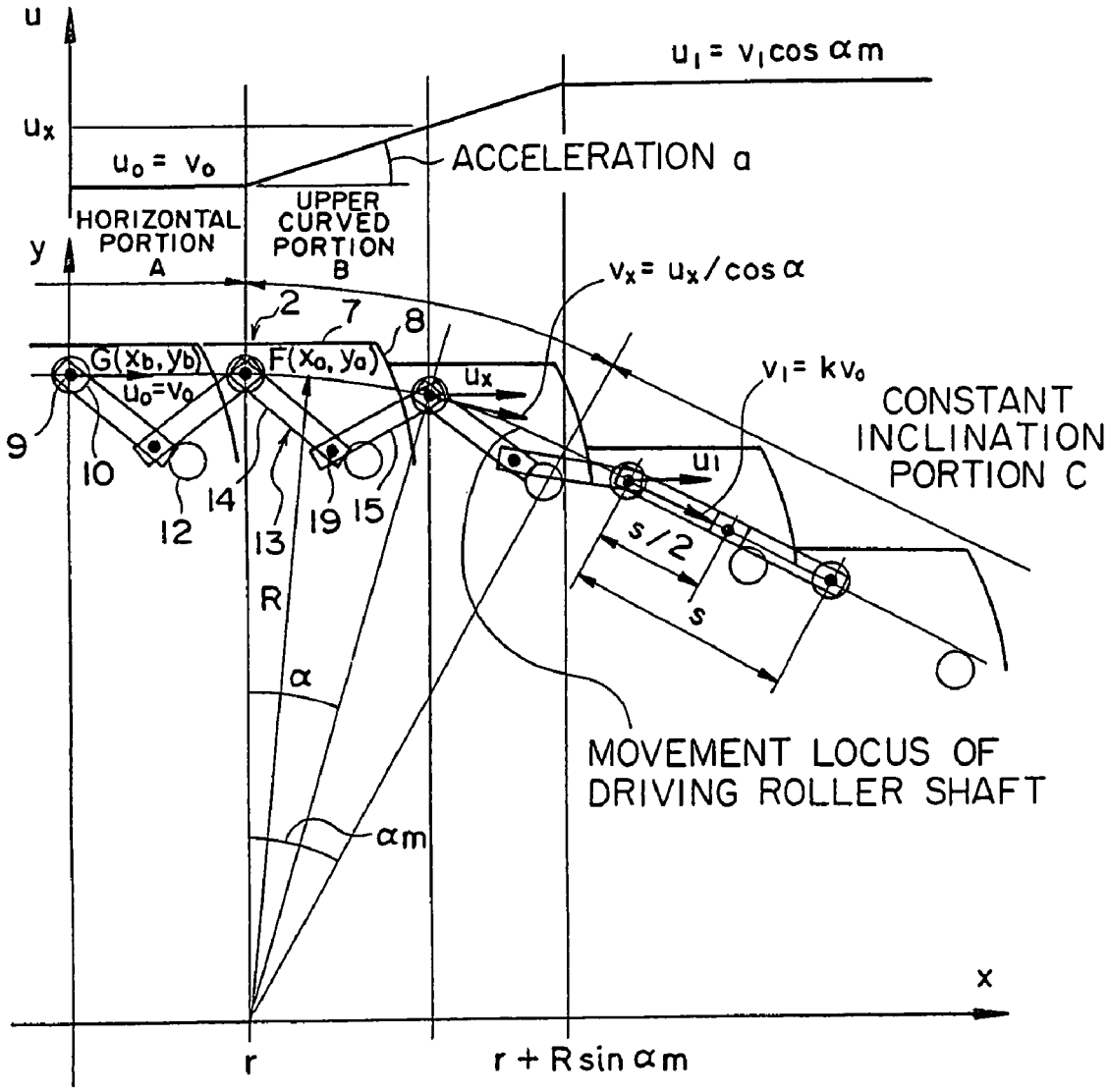
FIG. 3 is an explanatory diagram explaining a method for determining shape for risers and shapes for auxiliary tracks according to Embodiment 1.

Next, FIG. 3 is an explanatory diagram explaining a method for determining a shape for the risers 8 and shapes for the auxiliary tracks 6 according to Embodiment 1. The shapes for the auxiliary tracks 6 in the speed-changing region of the steps 2 are determined by finding a positional relationship between the step link roller shafts 9 of adjacent steps 2 from a step speed profile representing the speed of the step link roller shafts 9 over time. The shape for the risers 8 is determined by finding a relative positional relationship between each step 2 and an adjacent step 2 from the step speed profile such that the risers 8 align with the relative movement locus of the adjacent steps 2.

FIG. 3 is a side view of the steps 2 and the linking mechanisms 13 in a vicinity of the upper curved portion B. For simplification, only the first and second links 14 and 15 of the linking mechanisms 13 are shown. In addition, it is assumed that speed changing is performed only at the curved portions, and that the step speed profile as the steps 2 pass through the upper curved portion B is such that the horizontal traveling speed of the steps 2 changes with a constant acceleration. Furthermore, lengths of the first links 14 and lengths of the second links 15 are assumed to be equal to each other.

Now, let us assume that a central axis F ($x_a$, $y_a$) of the step link roller shaft 9 of a given step (first step) 2 is at a boundary point (r, R) between the upper landing portion A and the upper curved portion B on the movement locus of the central axis of the step link roller shaft 9. Furthermore, let a central axis G ($x_b$, $y_b$) of the step link roller shaft 9 of a second step 2 adjacent on an upper side of the first step 2 be positioned at a point (0, R) separated by −r along an x-axis from point F, and let that time be the origin for time (t=0).

If we let a speed in a direction of travel of the steps 2 at the upper landing portion A be $v_0$, a speed in a direction of travel of the steps 2 at the intermediate inclined portion C be $v_1$ (=$kv_0$, where k is a speed change ratio), and an angle of inclination at the intermediate inclined portion C be $\alpha_m$, then a horizontal speed $u_0$ of the steps 2 in the upper landing portion A is given by $u_0=v_0$, and a horizontal speed $u_1$ of the steps 2 in the intermediate inclined portion C is given by $u_1=v_1 \cos \alpha_m=kv_0 \cos \alpha_m$.

When the escalator is operating downward, the time $t_1$ required for the central axis G of the second step link roller shaft 9 to reach the boundary point between the upper landing portion A and the upper curved portion B is given by:

$$t_1=r/u_0 \quad (1).$$

If it is assumed that the horizontal speed of the steps 2 changes with a constant acceleration a in the upper curved portion B, then the time $t_2$ required for the central axis F of the first step link roller shaft 9 to reach the boundary point between the upper curved portion B and the intermediate inclined portion C, given that:

$$R \sin \alpha_m=u_0t_2+(at_2^2)/2 \quad (2)$$

and $$at_2=u_1-u_0 \quad (3),$$

is given by:

$$t_2=2R \sin \alpha_m/(u_1+u_0) \quad (4).$$

From Expression (3), the acceleration a is given by:

$$a=(u_1-u_0)/t_2 \quad (5).$$

In addition, the time $t_3$ required for the central axis G of the second step link roller shaft 9 to reach the boundary point between the upper curved portion B and the intermediate inclined portion C is given by:

$$t_3=t_1+t_2 \quad (6).$$

Hereinafter, it will be assumed that $t_1<t_2$, the positions ($x_a$, $y_a$) and ($x_b$, $y_b$) of the central axes F and G of the first and second step link roller shafts 9 at time t and the respective horizontal speeds $u_{xa}$ and $u_{xb}$ will be found for separate cases of t. From the results of those calculations, a method for finding the relative positions ($x_s$, $y_s$) of the central axes F and G and the shapes for the auxiliary tracks 6 will be demonstrated. Moreover, the movement loci of relative positions of adjacent steps 2 can be found by finding and joining together the relative positions ($x_s$, $y_s$) for each value of t.

When $t \leqq t_1$:

The horizontal speeds $u_{xa}$ and $u_{xb}$ of the central axes F and G of the first and second step link roller shafts 9 are given by:

$$u_{xa}=u_0+at \quad (7)$$

and $$u_{xb}=u_0 \quad (8),$$

and the x coordinate xa of the first central axis F is given by:

$$x_a=r+u_0t+(at^2)/2 \quad (9),$$

and if we let an angle of inclination of the escalator at the position of the first central axis F be $\alpha_a$, then:

$$\alpha_a=\sin^{-1}\{(x_a-r)/R\} \quad (10),$$

the y coordinate $y_a$ of the first central axis F is:

$$y_a=R\cos\alpha_a \quad (11),$$

and the coordinates ($x_b$, $y_b$) of the second central axis G are:

$$x_b=u_0t \quad (12)$$

and $$y_b=R \quad (13).$$

When $t_1<t \leqq t_2$:

The horizontal speeds $u_{xa}$ and $u_{xb}$ of the central axes F and G of the first and second step link roller shafts 9 are given by:

$$u_{xa}=u_0+at \quad (14)$$

and $$u_{xb}=u_0+a(t-t_1) \quad (15),$$

the x coordinate $x_a$ of the first central axis F is given by:

$$x_a=r+u_0t+(at^2)/2 \quad (16),$$

the angle of inclination $\alpha_a$ of the escalator at the position of the first central axis F is:

$$\alpha_a=\sin^{-1}\{(x_a-r)/R\} \quad (17),$$

the y coordinate $y_a$ of the first central axis F is:

$$y_a=R\cos\alpha_a \quad (18),$$

the x coordinate $x_b$ of the second central axis G is given by:

$$x_b=u_0t+\{a(t-t_1)^2\}/2 \quad (19),$$

an angle of inclination $\alpha_b$ of the escalator at the position of the second central axis G is:

$$\alpha_b=\sin^{-1}\{(x_b-r)/R\} \quad (20),$$

the y coordinate $y_b$ of the second central axis G is:

$$y_b=R\cos\alpha_b \quad (21).$$

When $t_2<t \leqq t_3$:

The horizontal speeds $u_{xa}$ and $u_{xb}$ of the central axes F and G of the first and second step link roller shafts 9 are given by:

$$u_{xa}=u_1 \quad (22)$$

and $$u_{xb}=u_0+a(t-t_1) \quad (23),$$

the x coordinate Xa of the first central axis F is given by:

$$x_a=r+u_0t_2+(at_2^2)/2+u_1(t-t_2) \quad (24),$$

the angle of inclination $\alpha_a$ of the escalator at the position of the first central axis F is:

$$\alpha_a=\alpha_m \quad (25),$$

the y coordinate $y_a$ of the first central axis F is:

$$y_a=R\cos\alpha_a-(x_a-r-R\sin\alpha_a)\tan\alpha_a \quad (26),$$

the x coordinate $x_b$ of the second central axis G is given by:

$$x_b=u_0t+\{a(t-t_1)^2\}/2 \quad (27),$$

the angle of inclination $\alpha_b$ of the escalator at the position of the second central axis G is:

$$\alpha_b=\sin^{-1}\{(x_b-r)/R\} \quad (28),$$

and the y coordinate $y_b$ of the second central axis G is:

$$y_b=R\cos\alpha_b \quad (29).$$

When $t>t_3$:

The horizontal speeds $u_{xa}$ and $u_{xb}$ of the central axes F and G of the first and second step link roller shafts 9 are given by:

$$u_{xa}=u_{xb}=u_1 \quad (30),$$

the angles of inclination $\alpha_a$ and $\alpha_b$ of the escalator at the positions of the central axes F and G are:

$$\alpha_a=\alpha_b=\alpha_m \quad (31),$$

the coordinates ($x_a$, $y_a$) of the first central axis F are given by:

$$x_a=r+u_0t_2+(at_2^2)/2+u_1(t-t_2) \quad (32)$$

and $$y_a=R\cos\alpha_a-(x_a-r-R\sin\alpha_a)\tan\alpha_a \quad (33),$$

and the coordinates ($x_b$, $y_b$) of the second central axis G are given by:

$$x_b=u_0t_3+at_2^2/2+u_1(t-t_3) \quad (34)$$

and $$y_b=R\cos\alpha_b-(x_b-r-R\sin\alpha_b)\tan\alpha_b \quad (35).$$

Using the above method, when the traveling speed in the horizontal direction in the upper curved portion B changes with a constant acceleration, the positions of the central axes F and G of the step link roller shafts 9 can be found as two adjacent steps 2 move from the upper landing portion A through the upper curved portion B to the intermediate inclined portion C. Once the positions of the central axes F and G are found, the movement loci of the relative positions of the adjacent step 2 can be found by successively calculating those relative positions along a time axis.

Figure 4:
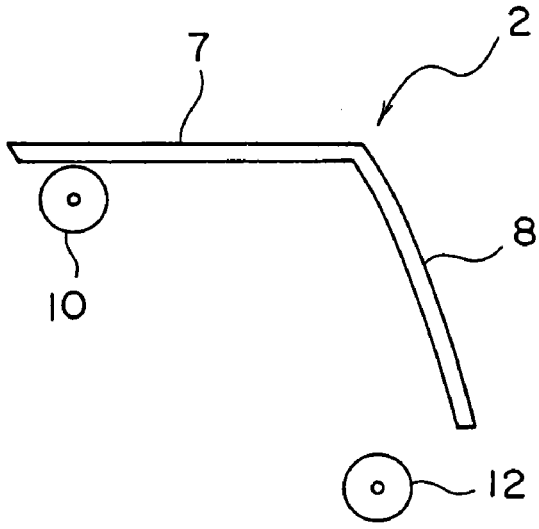
FIG. 4 is a side elevation showing an example of a riser shape according to Embodiment 1.

By determining the shape for the risers 8 such that the risers 8 align generally with the shape of the movement loci of the relative positions of the adjacent step 2, a high-speed inclined portion escalator can be obtained in which gaps do not form between mutually-adjacent steps 2 even during speed changing. FIG. 4 is a side elevation showing an example of a step 2 in which the shape for the risers 8 was determined in this manner.

Figure 5:
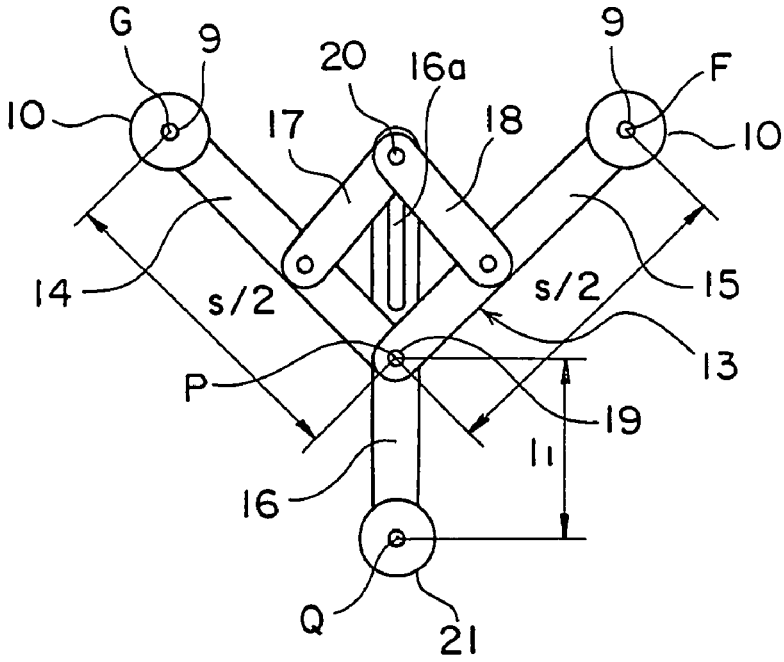
FIG. 5 is a front elevation showing a linking mechanism from FIG. 2 enlarged.

Here, in order to change the horizontal traveling speed of the steps 2 in the upper curved portion B with a constant acceleration, it is necessary to determine the shapes for the auxiliary tracks 6 so as to correspond thereto. The shapes for the auxiliary tracks 6 can also be found from the positions of the central axes F and G found above. This will be explained using FIG. 5. FIG. 5 is a front elevation showing a linking mechanism 13 from FIG. 2 enlarged.

The central axial positions of the step link roller shafts 9 of the two mutually-adjacent steps 2 are F and G, and if the lengths of the first and second links 14 and 15 are both assumed to be s/2, an inflection point P being a position of a central axis of the shaft 19 linking the first link 14 and the second link 15 can be found as a point of intersection between a first circle of radius s/2 centered about the first central axis F and a second circle of radius s/2 centered about the second central axis G.

Figure 6:
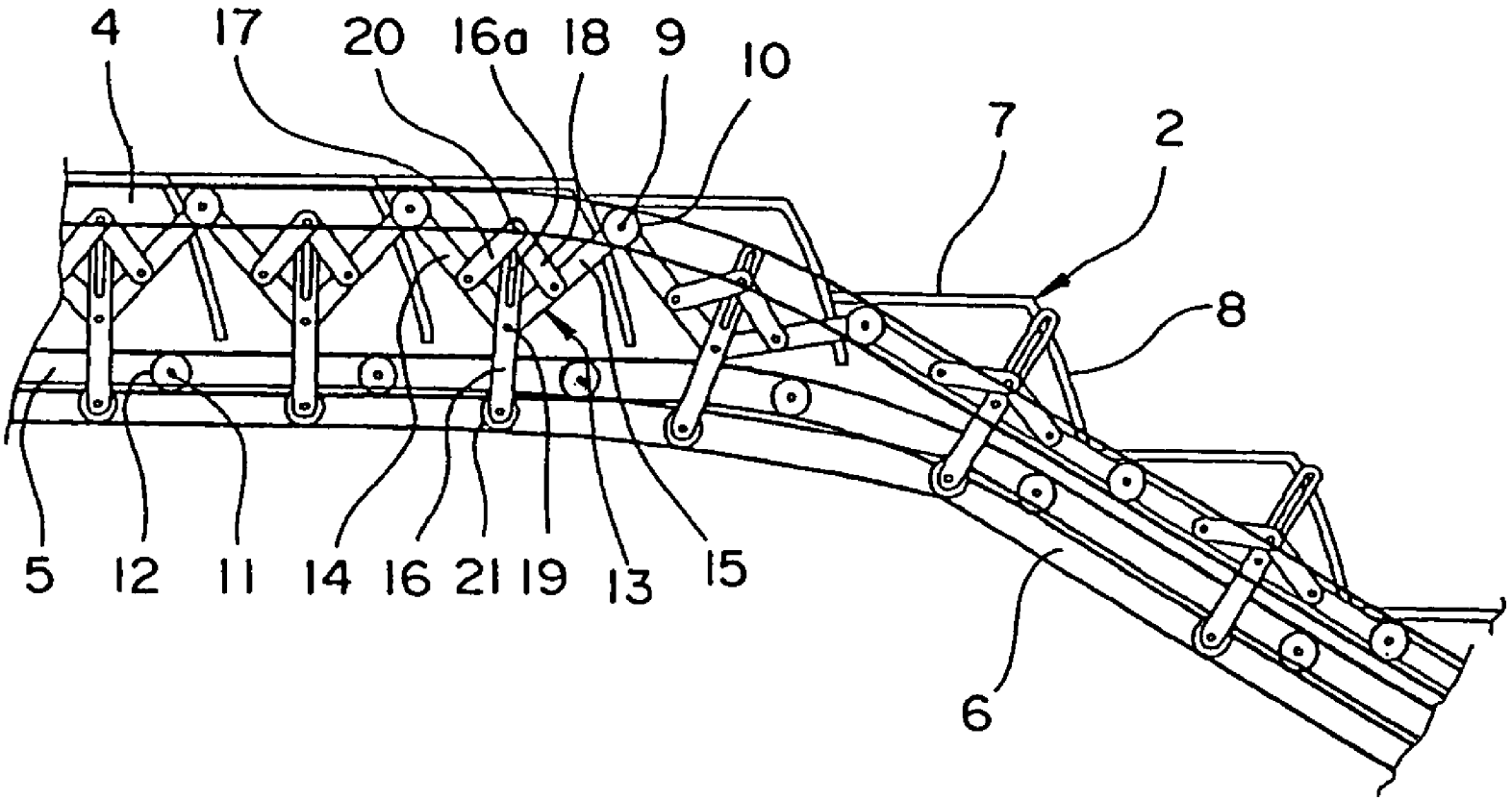
FIG. 6 is a side elevation showing an example of shapes for the auxiliary tracks according to Embodiment 1.

A position of a central axis Q of the auxiliary roller 21 can be found as a position of a bisector of an angle formed by the first link 14 and the second link 15 extended downward from the inflection point P by $l_1$. Once the movement locus of the central axis Q of the auxiliary rollers 21 is found, the shapes for the auxiliary tracks 6 can be found by drawing parallel lines separated by a radius of the auxiliary rollers 21 from that locus. FIG. 6 is a side elevation showing an example of shapes for the auxiliary tracks 6 in a vicinity of the upper curved portion B found in this manner.

Thus, in Embodiment 1, because the shape for the risers 8 and the shapes for the auxiliary tracks 6 are determined from a step speed profile in which the horizontal traveling speed of the steps 2 in the speed-changing region changes with a constant acceleration, a high-speed inclined portion escalator can be obtained in which a large acceleration does not arise in a horizontal direction in the steps 2 and gaps do not form between the steps 2 even during speed changing.

Embodiment 2

Figure 7:
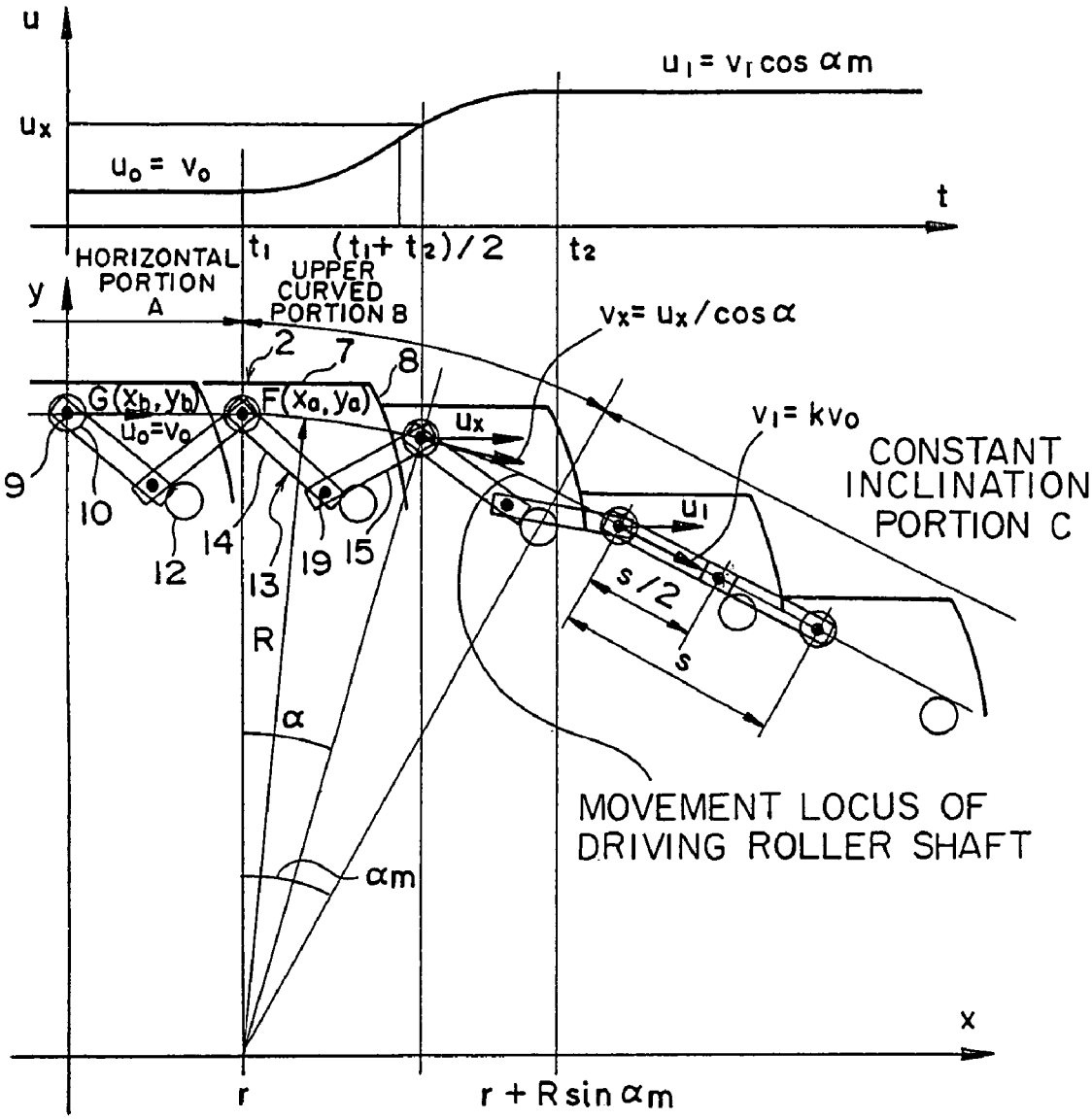
FIG. 7 is an explanatory diagram explaining a method for determining a shape for risers and shapes for auxiliary tracks according to Embodiment 2 of the present invention.

Next, FIG. 7 is an explanatory diagram explaining a method for determining a shape for risers and shapes for auxiliary tracks according to Embodiment 2 of the present invention. The overall construction is similar to that in FIGS. 1 and 2 except for the risers and the auxiliary tracks.

FIG. 7 is a side view of the steps 2 and the linking mechanisms 13 in a vicinity of the upper curved portion B. For simplification, only the first and second links 14 and 15 of the linking mechanisms 13 are shown. In addition, it is assumed that speed changing is performed only at the curved portions, and that the horizontal step speed profile as the steps 2 pass through the upper curved portion B is expressed by a smoothly-continuous curve. Specifically, the step speed profile has a shape such that two parabolas having downwardly convex and upwardly convex vertices at a point where speed change starts and a point where it finishes, respectively, are connected smoothly at an intermediate point between the vertices. Furthermore, lengths of the first links 14 and lengths of the second links 15 are assumed to be equal to each other.

First, an expression for the above parabolas is found. In the step speed profile in FIG. 7, parabolas having vertices at points $(t_1, u_0)$ and $(t_2, u_1)$ are given by:

$$u=k_1(t-t_1)^2+u_0 \tag{36}$$

and $$u=k_2(t-t_2)^2+u_1 \tag{37},$$

respectively, and the expression of the parabolas can be determined if k1 and k2 are found. Since the position and inclination of these parabolas are equal at $t=(t_1+t_2)/2$:

$$k_1[\{(t_1+t_2)/2\}-t_1]^2+u_0=k_2[\{(t_1+t_2)/2\}-t_2]^2+u_1$$

$$k_1\{(t_2-t_1)/2\}^2+u_0=k_2\{(t_1-t_2)/2\}^2+u_1 \tag{38}$$

and $$2k_1[\{(t_1+t_2)/2\}-t_1]=2k_2[\{(t_1+t_2)/2\}-t_2]k_2=-k_1 \tag{39}.$$

If we let the radius of curvature of the movement loci of the central axes of the step link roller shafts 9 in the upper curved portion B be R, and the angle of inclination in the intermediate inclined portion be $\alpha_m$, a distance L traveled horizontally by the steps in the upper curved portion (the speed-changing region) is given by:

$$L = R\sin\alpha_m \tag{40}$$

$$\int_{t_1}^{\frac{t_1+t_2}{2}} \{k_1(t-t_1)^2+u_0\}dt + \int_{\frac{t_1+t_2}{2}}^{t_2} \{k_2(t-t_2)^2+u_1\}dt = L$$

because this is equal to the integrated values of the step speed profile within a range $t_1 \leqq t \leqq t_2$.

From this:

$$t_2=\{2L/(u_0+u_1)\}+t_1 \tag{41}.$$

Consequently, from Expressions (38), (39), and (41):

$$k_1=\{(u_1+u_0)^2(u_1-u_0)\}/2L^2 \tag{42}.$$

The positions of the step link roller central axes F and G relative to time t for the speed change in the upper curved portion B given by Expressions (36) and (37) will now be found for separate cases of time t. Moreover, it is assumed that the positions shown in FIG. 7 are the initial positions of the central axes F and G (the positions at t=0). It is also assumed that $t_3=(t_2-t_1)/2$, $t_4=t_2-t_1$, $t_5=(t_1+t_2)/2$, and that $t_3<t_1<t_4<t_5<t_2$.

When $t<t_3$:

The horizontal speeds $u_{xa}$ and $u_{xb}$ of the central axes F and G are given by:

$$u_{xa}=k_1t^2+u_0 \tag{43}$$

and $$u_{xb}=u_0 \tag{44},$$

the x coordinate $x_a$ of the first central axis F is given by:

$$x_a=r+(k_1t^3)/3+u_0t \quad (45),$$

the angle of inclination of the escalator at the position of the first central axis F $\alpha_a$ is:

$$\alpha_a=\sin^{-1}\{(x_a-r)/R\} \quad (46),$$

the y coordinate $y_a$ of the first central axis F is:

$$y_a=R\cos\alpha_a \quad (47),$$

the coordinates ($x_b$, $y_b$) of the second central axis G are:

$$x_b=u_0t \quad (48)$$

and $$y_b=R \quad (49),$$

and the angle of inclination $\alpha_b$ at the position of the second central axis G is:

$$\alpha_b=0 \quad (50).$$

When $t_3 \leqq t < t_1$:

The horizontal speeds $u_{xa}$ and $u_{xb}$ of the central axes F and G are given by:

$$u_{xa}=-k_1(t-t_2+t_1)^2+u_1 \quad (51)$$

and $$u_{xb}=u_0 \quad (52),$$

the x coordinate $x_a$ of the first central axis F is given by:

$$x_a=r+(k_1t_3^3)/3+u_0t_3-k_1(t-t_2+t_1)^3/3+k_1(t_3-t_2+t_1)^3/3+u_1(t-t_3) \quad (53),$$

the angle of inclination at the position of the first central axis F $\alpha_a$ is:

$$\alpha_a=\sin^{-1}\{(x_a-r)/R\} \quad (54),$$

the y coordinate $y_a$ of the first central axis F is:

$$y_a=R\cos\alpha_a \quad (55),$$

the coordinates ($x_b$, $y_b$) of the second central axis G are:

$$x_b=u_0t \quad (56)$$

and $$y_b=R \quad (57),$$

and the angle of inclination $\alpha_b$ at the position of the second central axis G is:

$$\alpha_b=0 \quad (58).$$

When $t_1 \leqq t < t_4$:

The horizontal speeds $u_{xa}$ and $u_{xb}$ of the central axes F and G are given by:

$$u_{xa}=-k_1(t-t_2+t_1)^2+u_1 \quad (59)$$

and $$u_{xb}=k_1(t-t_1)^2+u_0 \quad (60),$$

the x coordinate $x_a$ of the first central axis F is given by:

$$x_a=r+(k_1t_3^3)/3+u_0t_3-k_1(t-t_2+t_1)^3/3+k_1(t_3-t_2+t_1)^3/3+u_1(t-t_3) \quad (61),$$

the angle of inclination at the position of the first central axis F $\alpha_a$ is:

$$\alpha_a=\sin^{-1}\{(x_a-r)/R\} \quad (62),$$

the y coordinate $y_a$ of the first central axis F is:

$$y_a=R\cos\alpha_a \quad (63),$$

the x coordinate $x_b$ of the second central axis G is given by:

$$x_b=r+k_1(t-t_1)^3/3+u_0(t-t_1) \quad (64),$$

the angle of inclination $\alpha_b$ at the position of the second central axis G is:

$$\alpha_b=\sin^{-1}\{(x_b-r)/R\} \quad (65),$$

and the y coordinate $y_b$ of the second central axis G is:

$$y_b=R\cos\alpha_b \quad (66).$$

When $t_4 \leqq t < t_5$:

The horizontal speeds $u_{xa}$ and $u_{xb}$ of the central axes F and G are given by:

$$u_{xa}=u_1 \quad (67)$$

and $$u_{xb}=k_1(t-t_1)^2+u_0 \quad (68),$$

the angle of inclination $\alpha_a$ at the position of the first central axis F is:

$$\alpha_a=\alpha_m \quad (69),$$

the coordinates ($x_a$, $y_a$) of the first central axis F are given by:

$$x_a=r+(k_1t_3^3)/3+u_0t_3-k_1(t_4-t_2+t_1)^3/3+k_1(t_3-t_2+t_1)^3/3+u_1(t-t_3) \quad (70),$$

and $$y_a=R\cos\alpha_a-(x_a-r-R\sin\alpha_a)\tan\alpha_a \quad (71),$$

the x coordinate $x_b$ of the second central axis G is given by:

$$x_b=r+k_1(t-t_1)^3/3+u_0(t-t_1) \quad (72),$$

the angle of inclination $\alpha_b$ at the position of the second central axis G is:

$$\alpha_b=\sin^{-1}\{(x_b-r)/R\} \quad (73),$$

and the y coordinate $y_b$ of the second central axis G is:

$$y_b=R\cos\alpha_b \quad (74).$$

When $t_5 \leqq t < t_2$:

The horizontal speeds $u_{xa}$ and $u_{xb}$ of the central axes F and G are given by:

$$u_{xa}=u_1 \quad (75)$$

and $$u_{xb}=-k_1(t-t_2)^2+u_1 \quad (76),$$

the angle of inclination $\alpha_a$ at the position of the first central axis F is:

$$\alpha_a=\alpha_m \quad (77),$$

the coordinates ($x_a$, $y_a$) of the first central axis F are given by:

$$x_a=r+(k_1t_3^3)/3+u_0t_3-k_1(t_4-t_2+t_1)^3/3+k_1(t_3-t_2+t_1)^3/3+u_1(t-t_3) \quad (78),$$

and $$y_a=R\cos\alpha_a-(x_a-r-R\sin\alpha_a)\tan\alpha_a \quad (79),$$

the x coordinate $x_b$ of the second central axis G is given by:

$$x_b=r+k_1\{(t_5-t_1)^3-(t-t_2)^3+(t_5-t_2)^3\}/3+u_0(t_5-t_1)+u_1(t-t_5) \quad (80),$$

the angle of inclination $\alpha_b$ at the position of the second central axis G is:

$$\alpha_b=\sin^{-1}\{(x_b-r)/R\} \quad (81),$$

and the y coordinate $y_b$ of the second central axis G is:

$$y_b=R\cos\alpha_b \quad (82).$$

When $t \geqq t_2$:

The horizontal speeds $u_{xa}$ and $u_{xb}$ of the central axes F and G are given by:

$$u_{xa}=u_1 \quad (83)$$

and $$u_{xb}=u_1 \quad (84),$$

the angles of inclination $\alpha_a$ and $\alpha_b$ of the escalator at the positions of the central axes F and G are:

$$\alpha_a=\alpha_m \quad (85)$$

and $$\alpha_b=\alpha_m \quad (86),$$

the coordinates ($x_a$, $y_a$) of the first central axis F are given by:

$$x_a=r+(k_1t_3^3)/3+u_0t_3-k_1(t_4-t_2+t_1)^3/3+k_1(t_3-t_2+t_1)^3/3+u_1(t-t_3) \quad (87)$$

and $$y_a=R\cos\alpha_a-(x_a-r-R\sin\alpha_a)\tan\alpha_a \quad (88),$$

and the coordinates ($x_b$, $y_b$) of the second central axis G are given by:

$$x_b=r+k_1\{(t_5-t_1)^3+(t_5-t_2)^3\}/3+u_0(t_5-t_1)+u_1(t-t_5) \quad (89)$$

and $$y_b=R\cos\alpha_b-(x_b-r-R\sin\alpha_b)\tan\alpha_b \quad (90).$$

Using the above method, when the traveling speed in the horizontal direction in the upper curved portion B changes so as to be expressed by a combination of two smoothly-connecting parabolas, the positions of the central axes F and G of the step link roller shafts 9 can be found as two adjacent steps 2 move from the upper landing portion A through the upper curved portion B to the intermediate inclined portion C. Once the positions of the central axes F and G are found, the movement loci of the relative positions of the adjacent step 2 can be found by a similar method to that of Embodiment 1, thereby enabling the shape for the risers 8 to be determined. The shapes for the auxiliary tracks 6 can also be determined.

Figure 8:
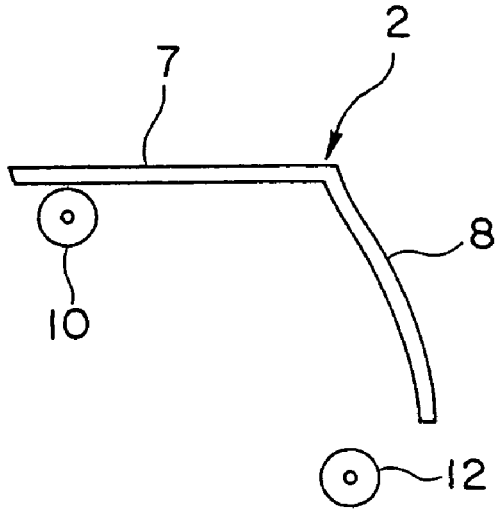
FIG. 8 is a side elevation showing an example of a riser shape according to Embodiment 2.
Figure 9:
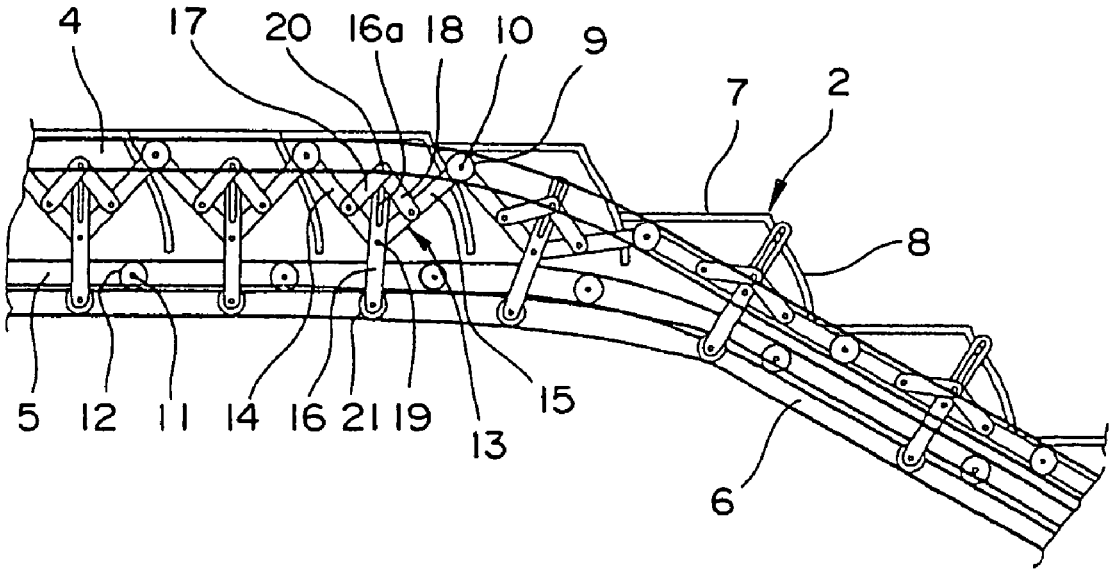
FIG. 9 is a side elevation showing an example of shapes for the auxiliary tracks according to Embodiment 2.
Figure 10:
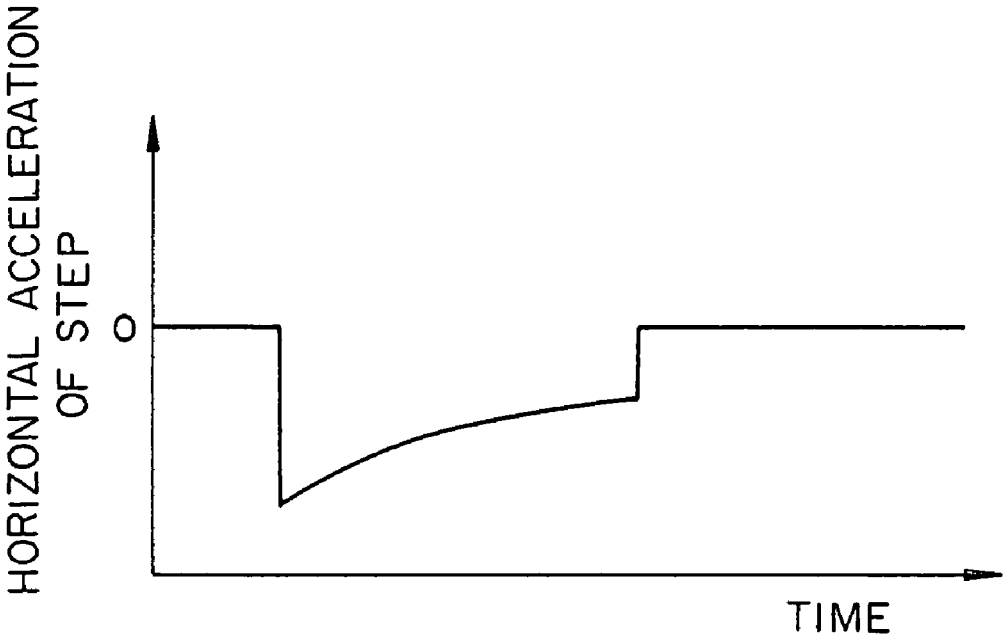
FIG. 10 is a graph of a relationship between time and acceleration showing an example of acceleration occurring in steps in a speed-changing region of a conventional high-speed inclined portion escalator.

FIG. 8 is a side elevation showing an example of a step 2 in which the shape for the riser 8 was determined in this manner. FIG. 9 is a side elevation showing an example of shapes for the auxiliary tracks 6 in a vicinity of the upper curved portion B found in this manner.

Thus, in Embodiment 2, because the shape for the risers 8 and the shapes for the auxiliary tracks 6 are determined from a step speed profile in which the horizontal traveling speed of the steps 2 in the speed-changing region changes is expressed by a combination of two smoothly-connecting parabolas, a high-speed inclined portion escalator can be obtained in which a large acceleration does not arise in a horizontal direction in the steps 2, the change in acceleration is smooth, and gaps do not form between the steps 2 even during speed changing.

Moreover, in Embodiments 1 and 2 above, the upper curved portion B has been explained as being the speed-changing region, but the shape for the risers 8 and the shapes for the auxiliary tracks 6 can also be similarly determined for the lower curved portion D.

In Embodiments 1 and 2 above, cases in which the horizontal traveling speed of the steps 2 in the speed-changing region changes with a constant acceleration, and cases in which the horizontal traveling speed is expressed by a combination of two smoothly-connected parabolas have been described, but the step speed profile may be any kind of straight line or curve provided that it can be represented by a mathematical expression.

In addition, in Embodiments 1 and 2 above, the shapes found from the step speed profile were used as the shape for the risers 8 and the shapes for the auxiliary tracks 6 without modification, but these shapes may also be used as the shape for the risers 8 and the shapes for the auxiliary tracks 6 after being approximated to arcs, straight lines, or other polynomials.

Furthermore, in cases where the shapes for the auxiliary tracks 6 are connected discontinuously between the curved portions B and D and the intermediate inclined portion C, the shapes for the auxiliary tracks 6 may also be selected so as to be interpolated by a small curve.

Further, the specific construction of the linking mechanisms 13 is not limited to those of Embodiments 1 and 2.

The invention claimed is:

1. An escalator having a high-speed inclined portion, the escalator comprising:

a main frame;

a main track disposed on the main frame, the main track having a cyclic path;

a plurality of steps, each step having a tread, a riser disposed on an edge of the tread, a step link roller shaft, and a step link roller rolling around the step link roller shaft, the step link roller being guided by the main track, the plurality of steps being linked endlessly and being moved cyclically along the cyclic path;

a plurality of linking mechanisms linking the step link roller shafts of mutually-adjacent pairs of the steps and changing pitch between the step link roller shafts by changing shape;

a rotatable auxiliary roller disposed on each of the linking mechanisms; and an auxiliary track disposed on the main frame, the auxiliary track changing traveling speed of the steps depending on position by guiding movement of the auxiliary rollers to change the shape of the linking mechanisms, wherein shape of the auxiliary track in a speed-changing region of the steps is determined by finding a positional relationship between the step link roller shafts of at least one of the steps and an adjacent step from a step speed profile representing speed of the step link roller shafts as a function of time, and shape for the riser is determined such that the riser aligns with relative positional relationship between the step and the adjacent step from the step speed profile.

2. The high-speed inclined portion escalator according to claim 1, wherein the step speed profile represents horizontal speed of the step link roller shafts as a function of time.

3. The high-speed inclined portion escalator according to claim 1, wherein the step speed profile in the speed-changing region is expressed by a straight line having a constant gradient.

4. The high-speed inclined portion escalator according to claim 1, wherein the step speed profile in the speed-changing region is expressed by a smoothly-continuous curve.

* * * * *